US006986558B2

(12) United States Patent
Egger

(10) Patent No.: US 6,986,558 B2
(45) Date of Patent: Jan. 17, 2006

(54) DRAWER SLIDE

(75) Inventor: Remo Egger, Bregenz (AT)

(73) Assignee: Grass America Inc., Kernersville, NC (US)

( * ) Notice: Subject to any disclaimer, the term of this patent is extended or adjusted under 35 U.S.C. 154(b) by 218 days.

(21) Appl. No.: 10/424,953

(22) Filed: Apr. 28, 2003

(65) Prior Publication Data

US 2003/0205955 A1 Nov. 6, 2003

(30) Foreign Application Priority Data

May 2, 2002 (DE) ..... 102 19 448

(51) Int. Cl.
*A47B 88/04* (2006.01)

(52) U.S. Cl. ..... 312/334.5

(58) Field of Classification Search ..... 312/330.1, 312/332, 334.1, 334.5, 334.6, 334.7, 350; 384/19, 20, 22

See application file for complete search history.

(56) References Cited

U.S. PATENT DOCUMENTS

| | | | | |
|---|---|---|---|---|
| 413,028 A | * | 10/1889 | Clapp | 384/22 |
| 2,494,221 A | * | 1/1950 | Wojakowski | 312/334.5 |
| 2,992,057 A | * | 7/1961 | Maxwell | 312/332 |
| 5,039,181 A | | 8/1991 | Lautenschlager | |
| 5,306,080 A | | 4/1994 | Lautenschlager et al. | |
| 5,310,255 A | * | 5/1994 | Ranallo | 312/334.5 |

FOREIGN PATENT DOCUMENTS

| | | | |
|---|---|---|---|
| DE | 7535313 | | 3/1976 |
| DE | 8001680 | | 4/1980 |
| DE | 3138204 | * | 6/1982 |
| DE | 3141158 | | 5/1983 |
| DE | 9002767 | | 5/1990 |
| DE | 19517601 | | 9/1998 |
| DE | 299 23 509 U1 | | 12/2000 |
| GB | 2037573 | | 7/1980 |
| GB | 2095537 | | 10/1982 |

* cited by examiner

*Primary Examiner*—James O. Hansen
(74) *Attorney, Agent, or Firm*—John M. Harrington; Kilpatrick Stockton LLP

(57) ABSTRACT

The invention concerns a drawer slide with width equalization and, if necessary, centering, including a cabinet-side and a drawer-side slide rail for both sides of the drawer. At least one elastic, springy flexible width equalization element is on both sides of the drawer—each is located between the cabinet-side slide rail and the cabinet body, indirectly or directly by, for example, an angle rail. The cabinet-side slide rail is located, releasable, on the cabinet-attached angle rail, axially engaged, but still moveable crosswise/transversely and is lockable in the end position of the drawer. The advantage here is that any desired combination between the width equalization element and the slide rail can be set flexibly and, additionally, the drawer slide is easy to maintain and simple to repair or replace.

15 Claims, 6 Drawing Sheets

VII
4
6
5
7
12
3
8
10
7
9
13
VII 4
5
7,17
6
21
12
14
3
10
11
9
7, 17
16
9
15
12

5
4
6
18.1
23
18
12,14
22
19
3
20
19
10
8
11
23
XI
9
12
XI 22
18
25
23
28
18.1
18.2
5
6

6
5
4
26
27
9
21
18.1
16
15
12
14
29

DRAWER SLIDE

FIELD OF THE INVENTION

The invention concerns a drawer slide with width equalization and, if applicable, middle centering.

BACKGROUND OF THE INVENTION

From the state of the art, centering devices of drawer slides inside cabinet walls are well known, which utilize for this purpose one of several different complicated mechanisms, as for example, inserted symmetrical folding shears or spring elements on both longitudinal sides of the drawer slides.

The disadvantage of this state-of-the-art centering mechanism is the fact that the whole lateral force, that works when, for example, the drawer is pushed in, must be transferred by the complicated mechanism and is, thus, exposed to increased wear. Besides, this centering mechanism is expensive to produce and maintain. Also, the centering only functions with parallel cabinet sides.

Document DE 299 23 509 U1 makes known a pull-out slide for a pull-out insert/drawer in a cabinet, including a cabinet-side and an insert-side slide rail for both sides of the insert; whereby, between each of the vertical side walls of the insert and the insert-side drawer slide is an elastic springy/flexible equalization element, so that the insert is centered in the center of the cabinet body crosswise to the insert direction. The equalization element can be designed as a spiral spring, leaf spring, compound spring or plate spring.

The disadvantage of this design is that the centering mechanism for the drawer is located between the drawer and the insert-side slide rail and must, therefore, be pre-mounted. This makes the system inflexible and makes replacement of the centering mechanism difficult in case of a defect.

SUMMARY OF THE INVENTION

The task of the present invention is a drawer slide with width equalization based on DE 299 23 509 U1, which can be adjusted in various ways, besides being easy to maintain and replace.

The fundamental characteristic of the invention is that at least one elastic springy/flexible width equalization element is located directly or indirectly between one of the cabinet-side slide rails and the cabinet body. The advantage here is now that the drawer, the cabinet-side and the insert-side slide rails can be installed to each other; whereas, before they were connected to the width equalization. This offers the basic and substantial advantage of the making the system more flexible, since the various pre-mounted drawer and slide rails can simply be combined with arbitrary or desired various width equalization elements, even at the place where the drawer is assembled. This arbitrary or desired combination between width equalization elements and guide rails can also later still be easily modified or altered after the initial assembly without having to remove the rails from the drawer or separating the rails.

The elastic, flexible/springy width equalization element can be made as a spiral spring, leaf spring or elastic, flexible/springy plastic element. Combinations thereof can also be used.

A preferred embodiment of the invention shows that on each of both drawer slide elements there is at least one elastic, flexible/springy width equalization element.

Further, we prefer that both end areas of each of the cabinet-side slide rails engage the width equalization element and these work by the application of the elastic flexible spring action.

The width equalization element can be designed as one-piece per cabinet-side slide rail element, or however, it can be designed as several width equalization elements; preferably two each per cabinet-side slide rail element that works on the ends' areas. At least four springy/flexible centering surfaces (width equalization elements) press then against the completely assembled drawer and this is positioned by the opposite centering surfaces to the force center.

A further embodiment of the invention prefers that the elastic flexible springy width equalization element is located directly over a fastening element between the cabinet-side slide rail and the cabinet on which the fastening element is advantageously attached in a releasable manner to the width equalization element. In another embodiment, the width equalization element can be fastened fixed (not releasable) to the fastening element.

Preferably this fastening element can serve simultaneously as the fastening for the cabinet rail and is particularly designed as an angle rail with two unequal 90° shanks. With one shank the angle rail can then be fastened to the cabinet and the cabinet-side slide rail can then be placed on the other shank.

The cabinet-side slide rail and the angle rail cannot move or shift apart, because a catch mechanism is provided between both parts, which prevents this from happening. Only if this catch mechanism is released, can both of these parts be separated, then again, for example, by pulling out. Connecting the two parts is accomplished similarly by doing the reverse—pushing the cabinet-side slide rail onto the angle rail specified at the cabinet until the catch mechanism engages, which corresponds to an overlapping of the two parts in a length-wise direction.

It is important that the cabinet-side slide rail is designed transverse or crosswise to the angle rail in defined borders; however, in the lengthwise direction, it is basically fixed. Thus, the width equalization element between the cabinet-side slide rail and the cabinet-fastened angle rail, which shifts the movable cabinet-side slide rail transverse to the pull-out direction of the drawer, can slide or shift because of the elastic, flexible/springy action of the width equalization element. There is a force equilibrium between the width equalization element of one side of the drawer to those of the other side of the drawer. Thus, for example, a central position of the drawer can take place within the cabinet opening. Also, an arbitrary or desired non-central position of the drawer within the cabinet opening is possible and can be attained, if desired, by various spring actions or tensions (the type or set tension of the spring). So, the force or action center can be shifted or moved by one-side adjustable spring action. The spring force or action can be adjusted by the fact that, for example, an adjustment component can be shifted or moved with wedge surfaces, which increase or reduce the tension of the spring components on a drawer side.

Preferably, the transverse mobility of the cabinet-side slide rail is placed or secured releasable, if the drawer is inserted completely into the opening of the cabinet.

For this, there is a lock system that is located in the back area of the angle rail, which clamps the cabinet-side slide rail to the angle rail in a releasable manner. This lock system can work form fitting (positive) and/or force (non-positive) or frictionally engaged. Especially for this, between the cabinet-side slide rail and the angle rail, then in the rear, the cabinet back wall's related side has friction-increased surfaces and/or teeth, which cause a form fitting and/or friction engagement if the drawer is completely closed. The friction fitting and/or form fitting can still, additionally, be increased by a clamp lever that, at least the parts of the cabinet-side slide rail and the angle rail, which have surfaces that point to each other, press on one another.

Since the adjustment of the drawer takes place after centering, the drawer can be completed by pushing the cabinet-side slide rail and the angle rail together with, for example, grooved 'hanging-up' installation surfaces. To increase the force, that for example, affects the grooved "snap-in" surfaces, these are additionally pressed by an, if necessary, eccentrically mounted lever.

In the following the invention is more closely described based on the enclosed figures, but it should limit the framework of the invention.

DETAILED DESCRIPTION

Figure 1:
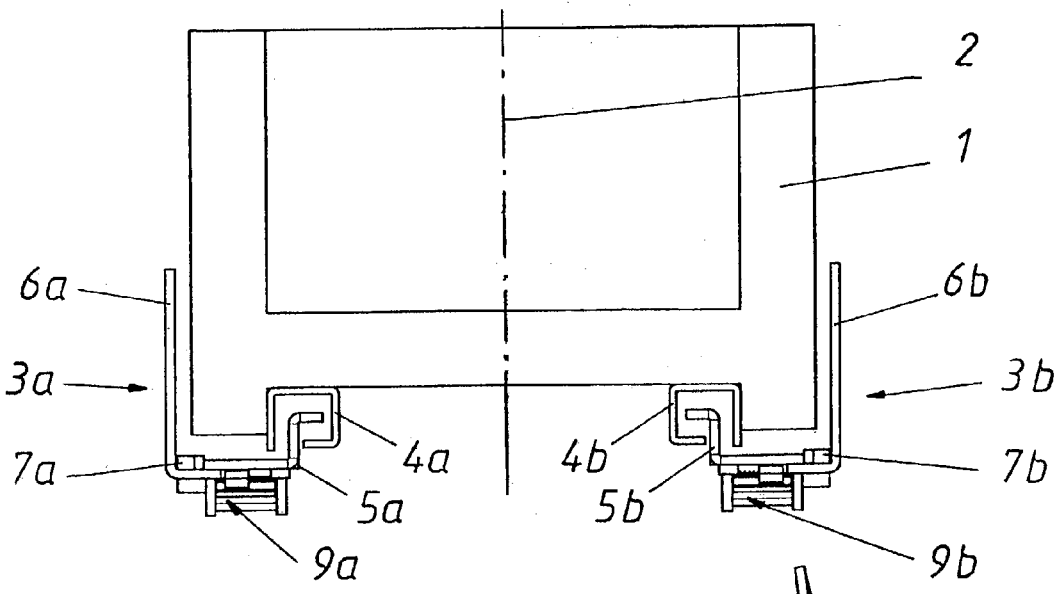
FIG. 1: A back view of an invention-related drawer slide with the drawer without the cabinet body.

In FIG. 1 a rear view is shown of the invention-related drawer slide (3) with two drawer slide elements (3*a* and 3*b*), which are located on the left and right of the center line (2) of the cabinet opening (not represented) and are held on the drawer (1); whereby, for reasons of clarity, no cabinet body is shown. The drawer (1) is, thus, held linearly adjustable in the cabinet opening in the cabinet on both of the drawer slide elements (3*a* and 3*b*) perpendicular to the drawing plane of FIG. 1. The two drawer slide elements (3*a* and 3*b*) are preferably arranged somewhat mirror-symmetrical to the center line (2) of the cabinet opening, but can also be easily changed to this.

The two drawer slide elements (3*a* and 3*b*) of the drawer slide (3) are spaced parallel and each has a drawer-side slide rail (4*a* or 4*b*) on which the drawer (1) rests linearly adjustable.

Each of these drawer-side slide rails (4*a,b*) is fastened to each corresponding cabinet-side slide rail (5*a* or 5*b*) by the respective sliding bearing or rolling bearing. Actual relative movement between which slide rails (4,5) takes place between the drawer (1) and the cabinet body.

The cabinet-side slide rails (5*a,b*) are connected in the presented example by each one of the angle rails (6*a* or 6*b*) with the body of the cabinet; whereby, the cabinet-side slide rails (5) are firmly connected (but releasable) when the drawer (1) is in the operational state with the angle rails (6), so that no relative movement between the respective parts (5,6) in an axial pull-out direction can take place.

In the transverse direction to the axial pull-out direction (transverse to the drawing plane in FIG. 1), however, the drawer (1) in its operational state must have a relative movement between the cabinet-side slide rail (5) and the angle rail (6).

When the drawer (1) is completely pushed into the cabinet opening, then preferentially also this transverse shift or movement between the parts (5,6) by a respective catching device is no longer possible.

Figure 2:
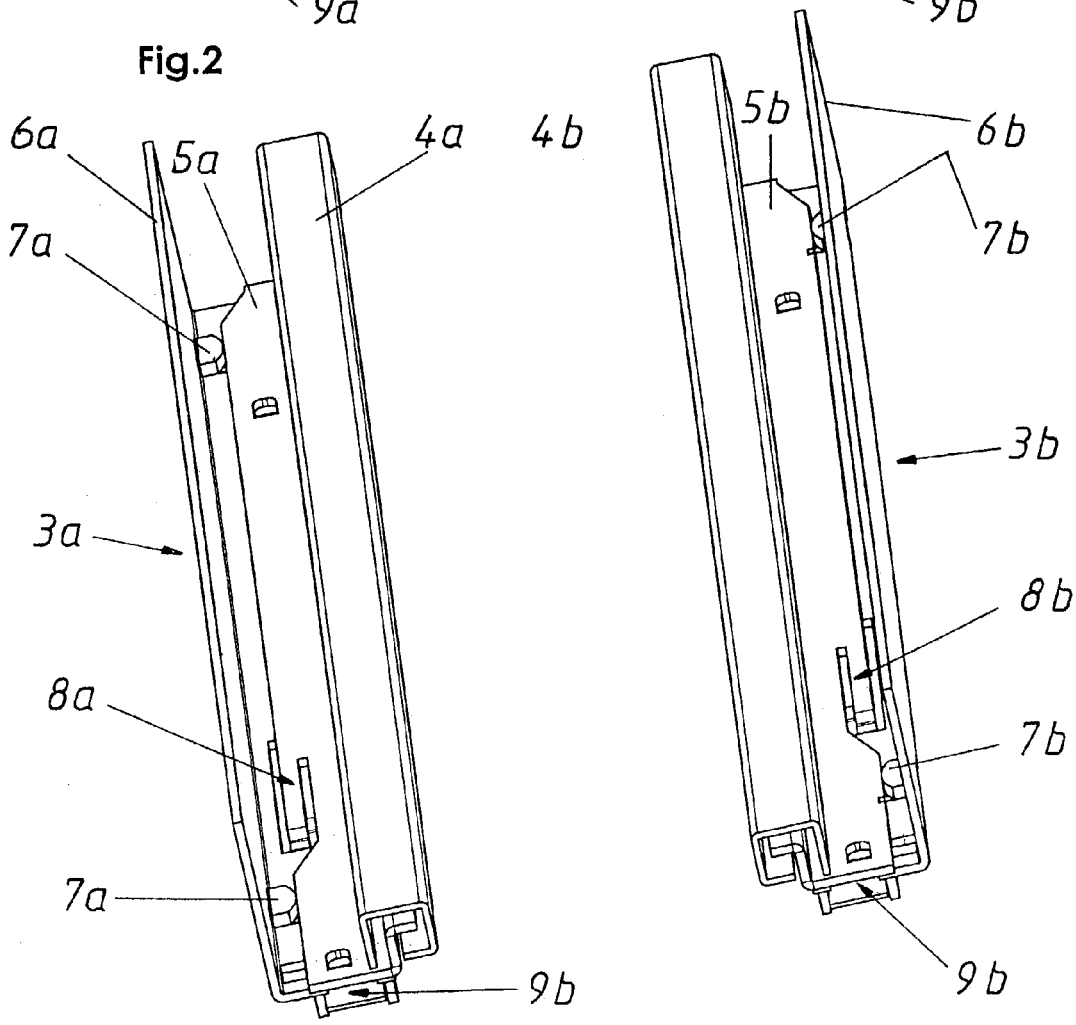
FIG. 2: A perspective view from above of the invention-related drawer slide according to FIG. 1 without the drawer and without the cabinet body.

Now in FIG. 2 the invention-related drawer slide (3) according to FIG. 1 is seen with a perspective view; however, for reasons of clarity, the drawer (1) is also not represented.

Figure 3:
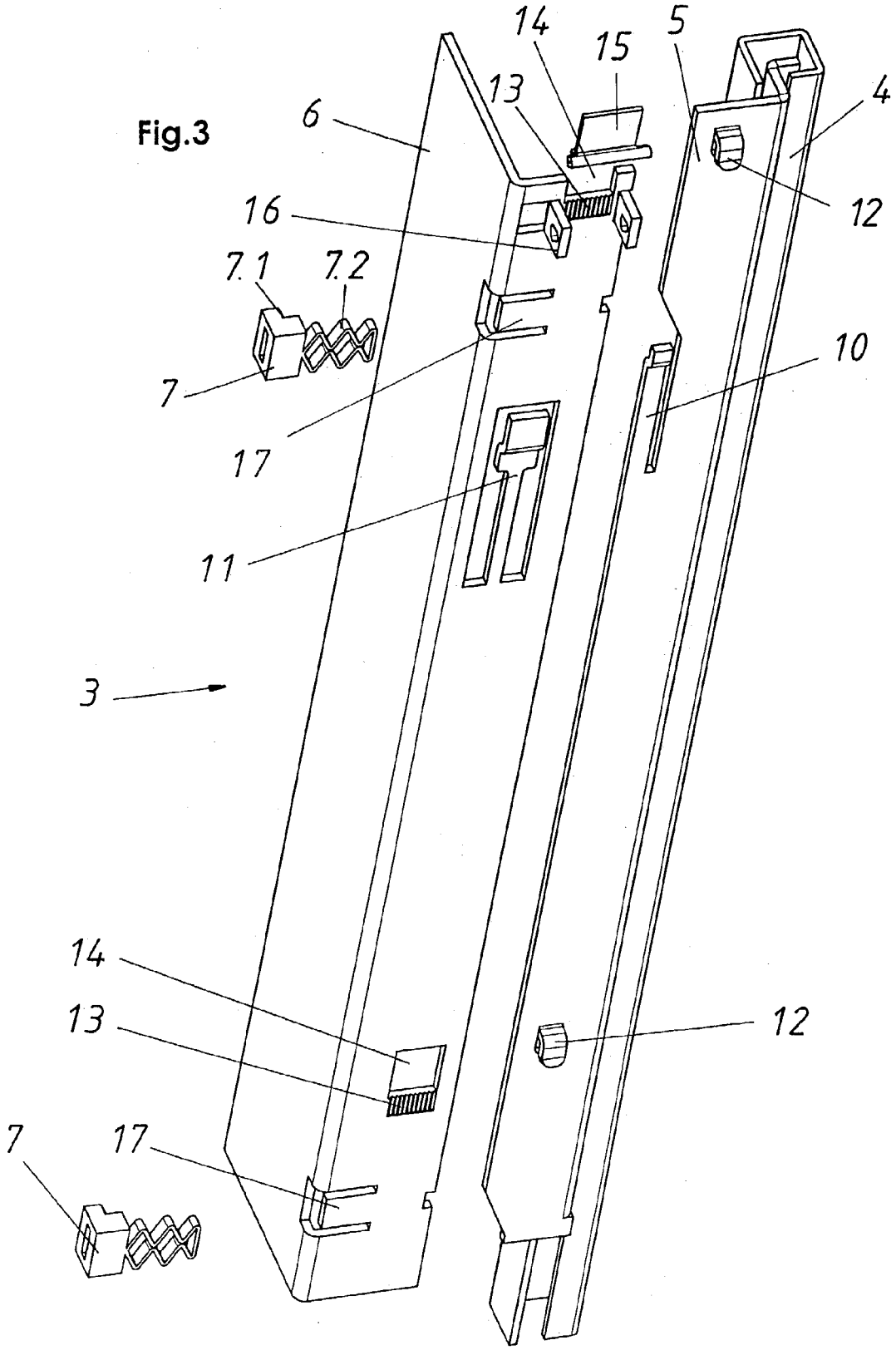
FIG. 3: An exploded representation from below of the left invention-related drawer slide according to FIGS. 1 and 2.

The releasable axial catch (8*a,b*) between the cabinet-side slide rails (5*a,b*) and the angle rails (6*a,b*) is accomplished by corresponding spring tongues (10,11) shown in FIG. 3. These snap into one another in such a manner that they reliably prevent an axial relative movement of the building components (5,6); however, a relative transverse movement of the building components (5,6) still make an axial pull-out direction possible.

This transverse movement is to guarantee namely a width adjustment of the drawer (1) and makes in particular a middle centering of the drawer (1) possible, but also makes an off-center position of the drawer (1) in relation to the center line (2) of the cabinet opening possible.

To achieve this width equalization, there are always two pieces of flexible or elastic centering components provided as width equalization element (7*a* or 7*b*) per drawer slide element (3*a* or 3*b*). These width equalization elements are respectively located between the angle rails (6*a,b*) and the corresponding cabinet-side slide rails (5*a,b*) preferably on the ends of the sides.

If, according to FIG. 1, this left width equalization element (7*a*) is designed in the same manner as the right equalization element (7*b*), then both sides activate the same large spring force or action on the cabinet-side slide rails (5*a,b*), and so the drawer-side slide rails (4*a,b*) is held together with the drawer (1) in the cabinet center in relation to the center of the cabinet opening, that corresponds to a force center.

In other embodiments, naturally, also unequal or dissimilar width equalization elements (7*a,b*) are possible, as well as also unequal or dissimilar set tensions or stress of the same width equalization elements (7), so that the drawer (1) is held eccentrically to the center line (2) of the cabinet opening.

According to FIG. 2, there are four width equalization elements (7) per drawer slide (3), and, respectively, two equalization elements (7*a* or 7*b*) per drawer slide element (3*a* or 3*b*) that are set on the angle rails (6*a,b*) end-sided on the fastening tabs (17) in such a manner that they always deploy their force activation between the angle rails (6) and the corresponding cabinet-side slide rails (5). The width equalization element (7*a,b*) each has a pressure surface (7.1) that bears on the cabinet-side slide rail (5) and a spring area (7.2) to support on the angle rail (6).

In order to achieve a corresponding absorption and/or braking of the transverse movement between the angle rail (6) and the cabinet-side slide rail (5), there are friction-increasing devices (12–14) between both these parts (5,6). In order to completely prevent this transverse movement between the angle rail (6) and the cabinet-side slide rail (5), there are clamping devices (15,16) between both parts (5,6) and which define the width catch (9) and which work together with the friction-increasing devices (12–14) in this example.

This width absorption and width engagement between both parts (5,6) is achieved, according to FIG. 3, because the catch hooks (12) of the cabinet-side slide rail (5) in particular engage with their end-sides in the corresponding window (14) of the angle rail (6) and engage through this in such a manner that the catch hooks (12) with their inner surfaces then correspondingly lie on friction-increasing catch surfaces (13), so that a relative transverse movement of both parts (5,6) is absorbed and/or braked by increased friction.

Figures 6, 7:
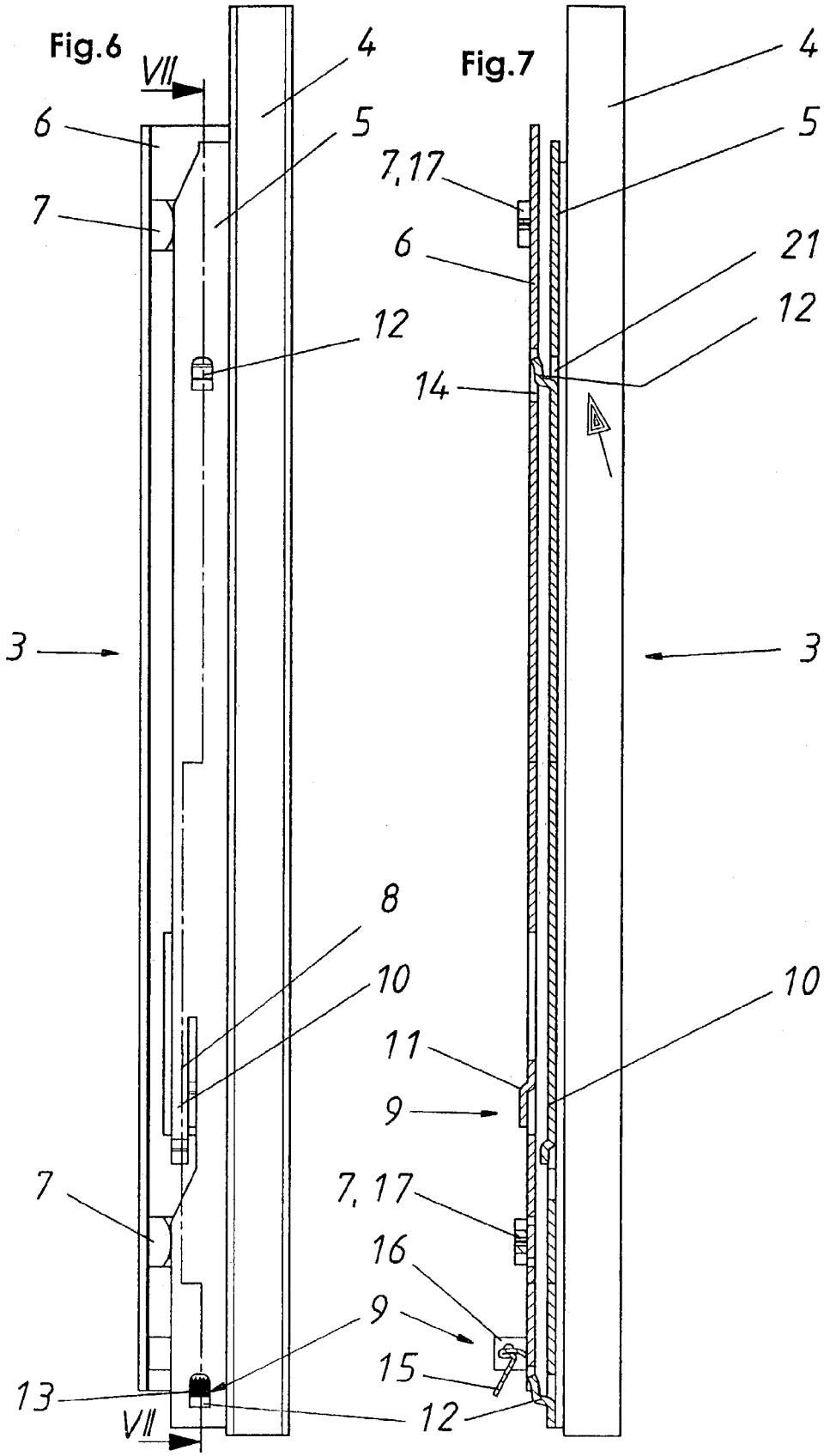
FIG. 6: The upper view of the invention-related drawer slide in the assembled state according to FIG. 4.
FIG. 7: Side view of the section of the invention-related drawer slide in the assembled state according to FIG. 6 along the Line VII—VII.
Figure 11:
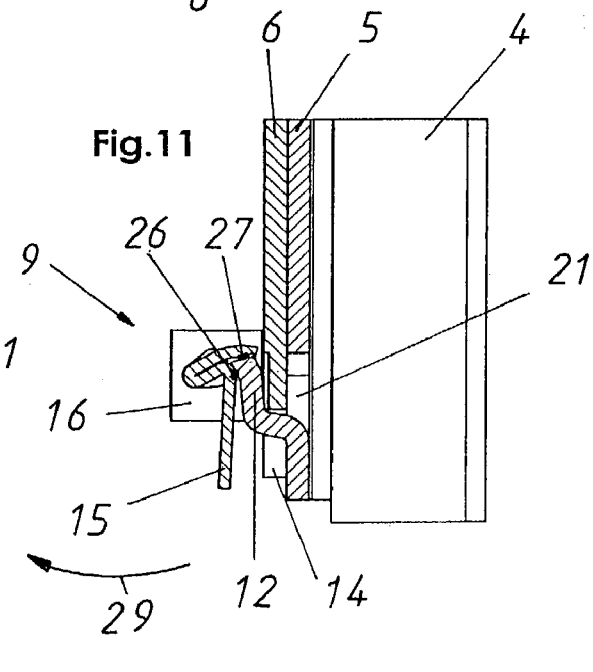
FIG. 11: A section through the lower end area of the invention-related drawer slide according to FIG. 9 along the Line XI—XI with the representation of the wedging between the angle rail and the cabinet-side slide rail.

The friction between the catch hooks (12) and the catch surfaces (13) can, additionally, still be substantially increased so that by a clamp lever (15) that, according to FIGS. 7 and 11, is held by a bearing (16) on the angle rail (6) by increasing the pressure force of both parts (5,6) by pressing them together, forms the width catch (9) in the transverse direction to the pull-out direction. The clamp lever can here, for example, be designed as an eccentric or control lever and the catch surface (13) can have corrugations.

Figure 4:
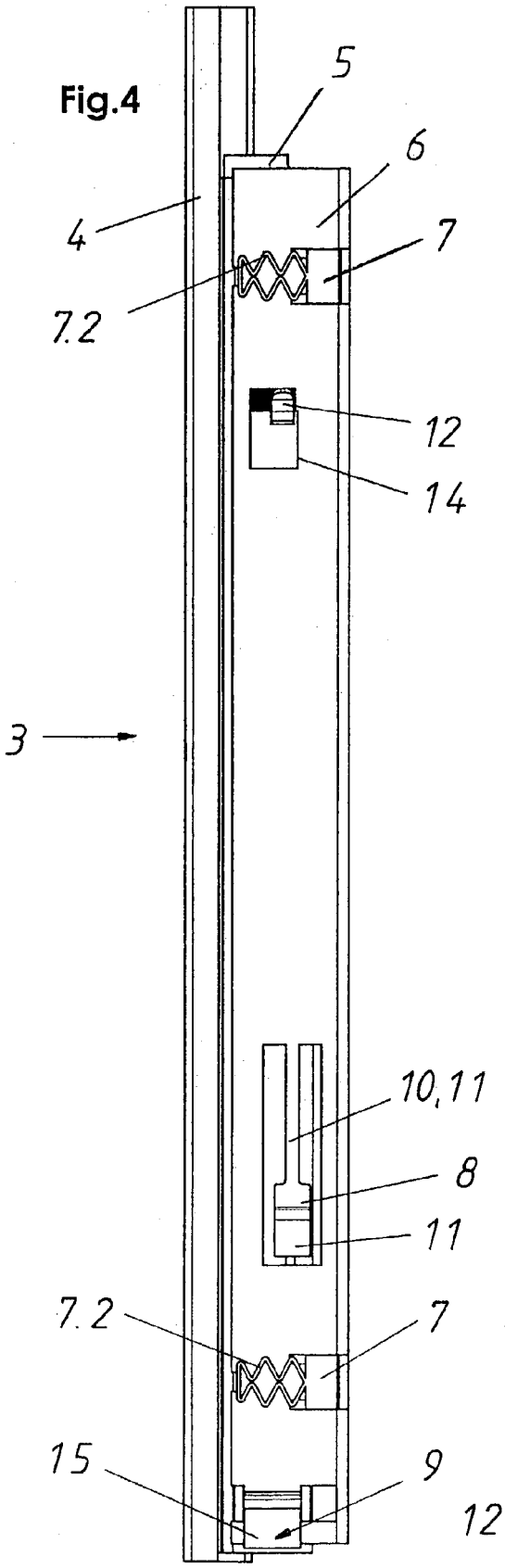
FIG. 4: The lower view of the invention-related drawer slide in the assembled state according to FIG. 3.

FIG. 4 shows the lower view of the drawer slide (3) in the assembled state according to FIG. 3; whereby, both the axial catch (8), working together with the spring tongues (10,11) and the width catch (9) with the clamp lever (15) are shown, as is also the absorption device with the hooks (12), the window (14) and the surfaces (13) that engage with one another.

The width equalization element (7) is attached on the fastening tab (17) to both ends of the angle rail by spring-loaded stress and is supported there with its spring area (7.2), which is installed in this manner on the angle rail so that the width equalization element (7) has the smallest length in the unloaded or unstressed state, but, however, when loaded or stressed the cabinet-side slide rail (5) pressed on the width equalization element (7) then the spring area (7*b*) of the width equalization element (7) is pulled lengthwise increasing the spring set tension or stress.

Figure 5:
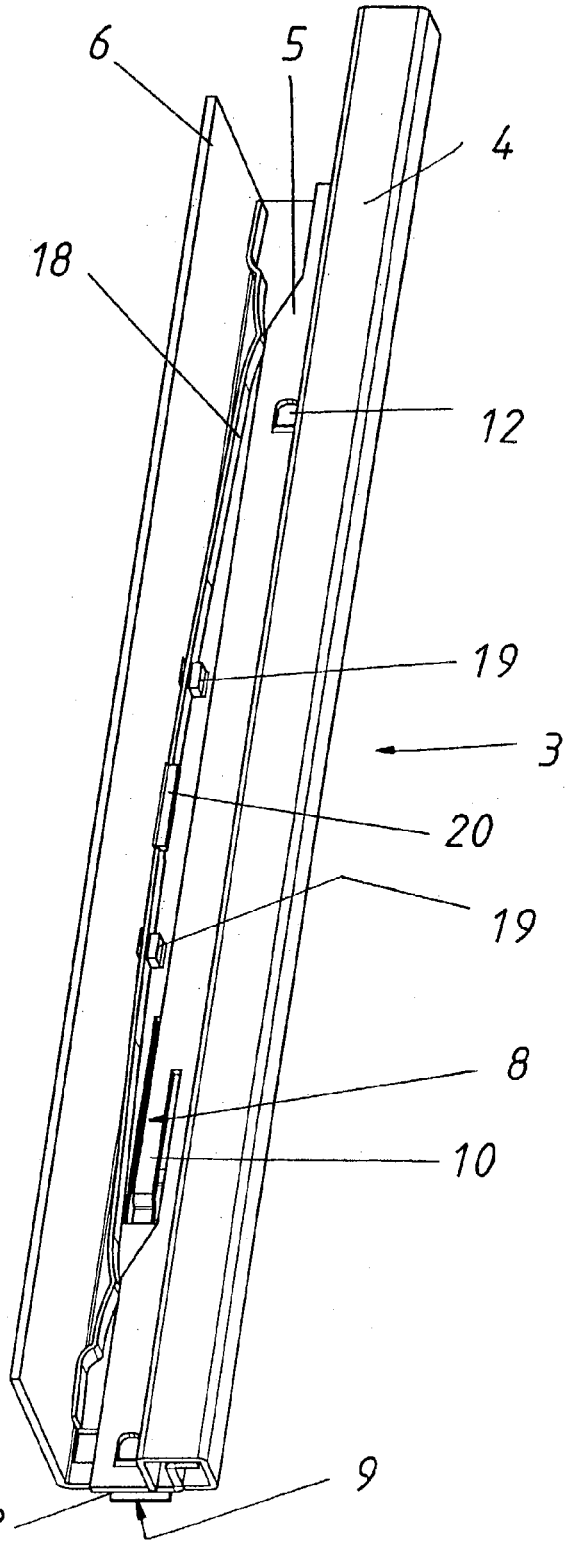
FIG. 5: A perspective representation from above of another embodiment of the invention-related drawer slide according to FIGS. 3 and 4 with a leaf spring as a width adjustment element.

FIG. 5 shows another embodiment of the width equalization element (7) of FIGS. 1–4 in the form of a flat spring (18) that is fastened on the angle rail (6) by the side mounting (19) and the height mounting (20). The same building components are again described with the same reference symbols as shown in FIGS. 1 to 4.

FIGS. 6 and 7 show again the first embodiment of a drawer slide (3) according to FIGS. 1–4, each with two end-sided located width equalization elements (7) as springy flexible centering parts per drawer slide element (3*a,b*). FIG. 7 shows a section along Line VII—VII of FIG. 6; whereby, the angle rail (6) and the cabinet-side slide rail (5), still not completely operational, are connected with one another.

FIGS. 5 and 8–11 also show a second embodiment with a flat spring (18) as a width equalization element, as well as a corresponding blocking device (22–24) of the flat spring (18). The same building components are again described with the same reference symbols as shown in FIGS. 1–4, 6 and 7 of the first embodiment.

Figure 8:
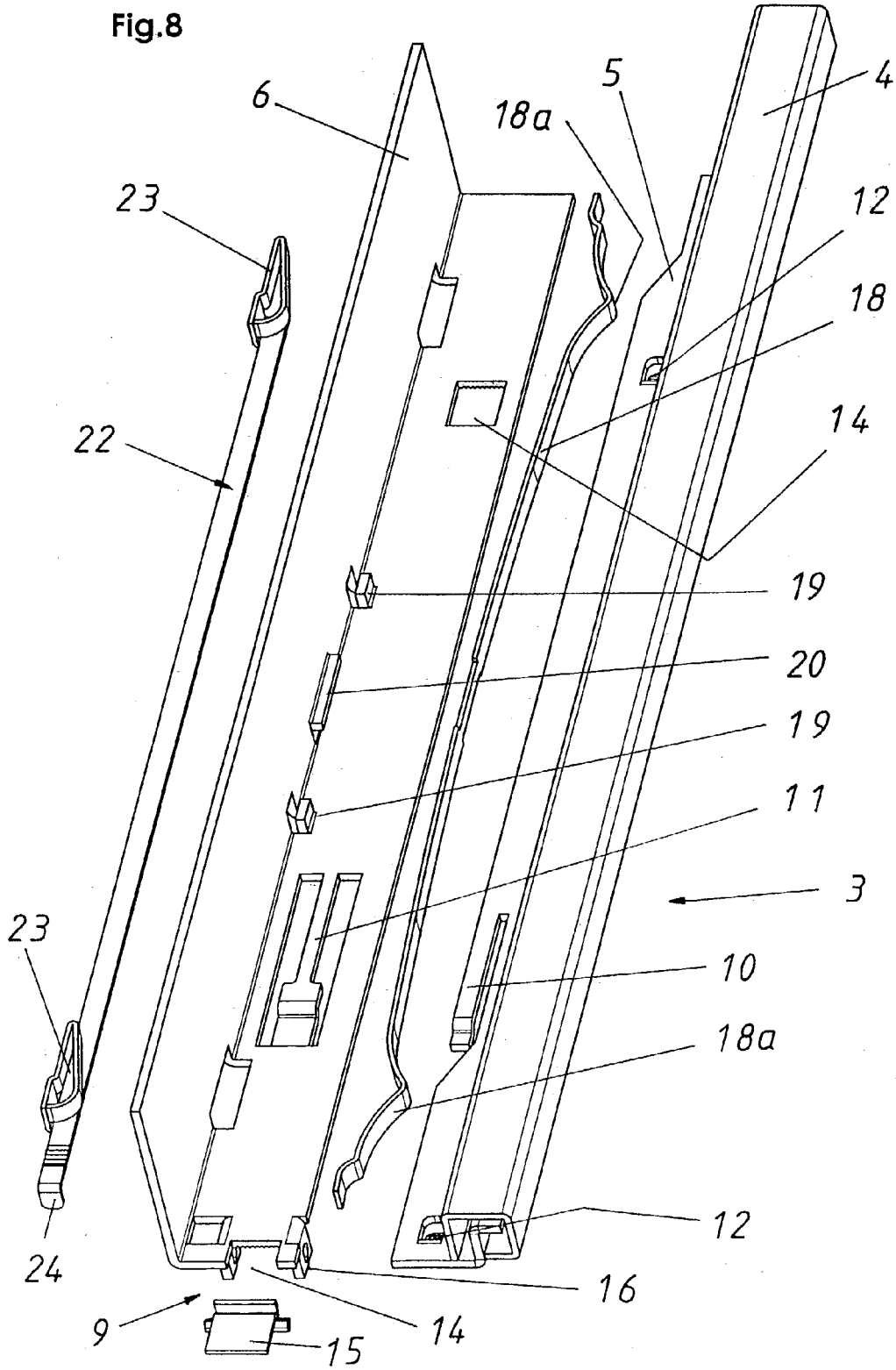
FIG. 8: An exploded representation of the invention-related drawer slide according to FIG. 5 with the wedge surface element.

FIG. 8 shows an exploded representation of the second embodiment with the flat spring (18) and the corresponding block device (22–24), which consists of a wedge surface slider (22) that has almost the same length as the leaf spring (18) and on the end side always has a wedge surface element (23) as well as at least one handle (24) on a side to slide manually.

Figure 9:
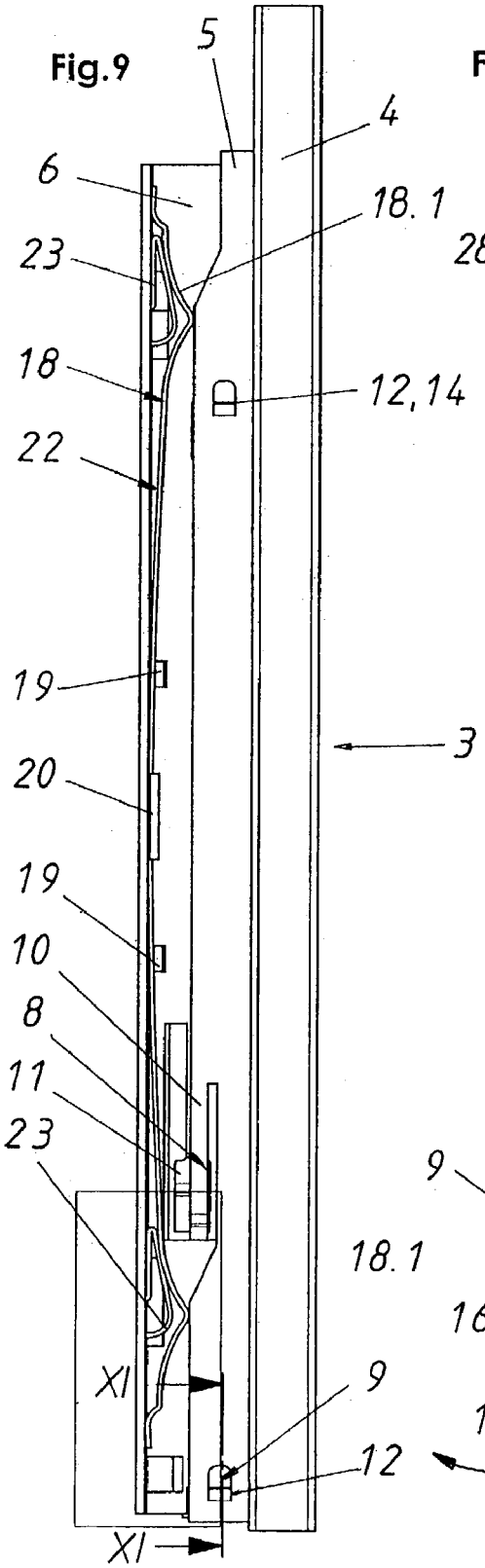
FIG. 9: Side view of the invention-related drawer slide according to FIG. 8 in an assembled state.

Now FIG. 9 shows the drawer slide according to FIG. 8 in the assembled state, which should be recognized that there are wedge surface elements (23) of the wedge surface sliders (22) in the area of the spring elevation (18.1) of the width equalization element (18).

Figure 10:
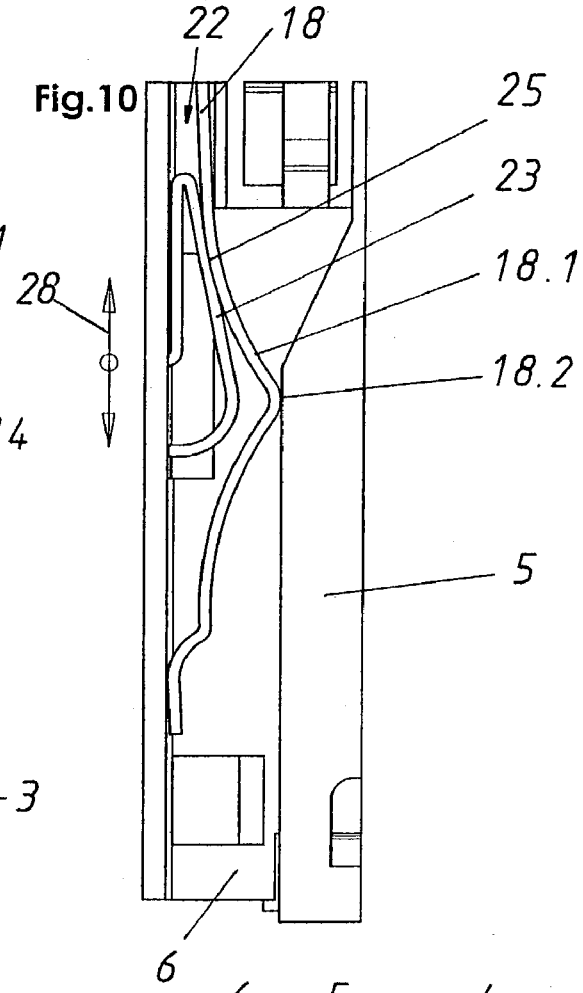
FIG. 10: An enlarged partial representation of the lower end area of the invention-related drawer slide according to FIG. 9.

FIG. 10 is an exploded representation of the drawer slide (3) of the lower area of the drawer slide (3) embodiment according to FIG. 9. According to FIG. 10 the wedge surface slider (22) can be shifted upward in the movement direction (28) relative to the width equalization element (18) and can be shifted in the same manner downward so that the wedge surface element (23) is in the contact area (25) of the wedge surface element (23) and the spring elevation (18.1) of the width equalization element (18), allowing the spring tension or stress of the spring elevation (18.1 ) of the width equalization element (18) to be varied.

With this the position of the drawer (1) can be moved in the cabinet opening relative to the center line (2). The spring action/force of the spring stress of the width equalization element (18) can also be increased by, according to FIG. 10, the wedge surface element (23) of the wedge surface slider (22) that is moved upward in sliding direction (28); whereby, the spring experiences a reinforcement or stiffening and, thus, the drawer (1) is pressed or forced away from this drawer slide element (3*a*) in the direction of the oppositely located drawer-slide element (3*b*). So the spring elevation (18.1) of the width equalization element (18) presses over a small contact surface (18.2) on the cabinet-side slide rail (5).

It is sufficient, only if a wedge surface slider (22) is provided, that can be located on the left (3*a*) or right drawer slide element (3*b*). Naturally it is also possible to have one or more wedge surface sliders (22) per drawer slide element (3*a* and 3*b*).

Likewise, in the lower area of FIG. 9, a section along the Line XI—XI is shown that corresponds to FIG. 11 in an enlarged representation.

There again, the wedging between the angle rail (6) and the cabinet-side slide rail (5) is shown, so that the clamp lever (15), then can be tilted or swiveled, is held by the bearing (16) on the angle rail (6). The clamp lever (15) works in an engaged position, according to FIG. 11, with its contact surface (26) on the catch hook (12) that is securely connected with the cabinet-side slide rail (5) and engages the angle rail (6) through the window (14), resulting in a reliable engagement of the building components (5,6). The catch hook (12) is preferably made out of the material of the cabinet-side slide rail (5) so that an opening (21) remains in the cabinet-side slide rail (5).

Now if the clamp lever (15) is swiveled out around the bearing (16) in rotation direction (29) out of the engaged position, then the catch contact area loses contact, the contact or press force on the catch hook (12) decreases and then disappears completely and the second front contact area (27) of the clamp lever (15) gains influence, resulting in a release between both parts (5 and 6) if the catch tongues (10,11) for the axial catch are operated.

In addition, the clamp lever (15) operates on the one hand to lock against the transverse movement between the parts (5,6) but also serves as the initial release movement of both parts (5,6) in an axial direction after the catch (8) of the spring tongues (10,11) is activated.

The invention concerns in summary a drawer slide with width equalization and, if necessary, centering, including a cabinet-side and a drawer-side slide rail for both sides of the drawer. There is at least one elastic flexible width equalization element for each drawer side and is between the cabinet-side slide rail and the cabinet body, indirectly or directly located over, for example, an angle rail. The cabinet-side slide rail is located releasable on the angle rail securely fastened to the cabinet, axially engaged but is movable transversely and can be engaged or locked in the end position of the drawer.

The advantage here is that arbitrary or desired combination can be flexibly set between the width equalization element and the slide rails and, in addition, the drawer slide is easy to maintain, adjust or replace if necessary.

DRAWING LEGEND

1. Drawer
2. Center line of the cabinet opening
3. Drawer slide; 3*a,b* Elements of 3
4. Drawer-side slide rail
5. Cabinet-side slide rail
6. Angle rail
7. Width equalization element; 7.1 Pressure surface; 7.2 Spring area
8. Axial catch between 5 and 6
9. Width catch between 5 and 6
10. Catch tongue of 5
11. Catch tongue of 6
12. Catch hook of 5
13. Catch surface of 6
14. Window of 6
15. Clamp lever
16. Bearing for 15 of 6
17. Fastening tabs for 7 of 6
18. Width equalization element; 18.1 Spring elevation; 18.2 Contact surface
19. Lateral mounting of 18 on 6
20. Vertical mounting of 18 on 6
21. Opening of 5 by 12
22. Wedge surface slider
23. Wedge surface element
24. Handle of 22
25. Contact area of 18 with 23
26. Contact area of 15 with 12 to catch
27. Contact area of 15 with 12 to release
28. Longitudinal movement of 22
29. Rotation direction

What is claimed is:

1. Drawer slide with width equalization and centering, comprising:

a drawer slide element mountable to a cabinet within a drawer opening;

a cabinet-side slide rail supported on the drawer slide element for movement relative to the drawer slide element in a direction transverse of a longitudinal axis of the drawer slide element;

a drawer-side slide rail mountable to a drawer and coupled to the cabinet-side slide rail for movement relative to the cabinet-side slide rail and drawer slide element in a direction parallel to the longitudinal axis of the drawer slide element between fully open and fully closed positions of the drawer; and at least one elastic spring width equalization element that is disposed between the cabinet-side slide rail and the drawer slide element and urging the cabinet-side rail and drawer-side slide rail away from the drawer slide element.

2. Drawer slide according to claim 1, wherein the at least one elastic spring width equalization element further comprises at least one of a spiral spring, a leaf spring, a plate spring, an elastic flexible spring element, and a plastic spring element.

3. Drawer slide according to claim 1, wherein the at least one elastic spring width equalization element has an adjustable spring force.

4. Drawer slide according to claim 3 further comprising wedge surfaces of a wedge surface slider for adjusting the spring force of the at least one elastic spring width equalization element.

5. Drawer slide according to claim 1 further comprising a plurality of said elastic spring width equalization elements disposed between the cabinet-side slide rail and the drawer slide element and urging the cabinet-side rail and drawer-side slide rail away from the drawer slide element.

6. Drawer slide according to claim 5 wherein at least one of said plurality of elastic spring width equalization elements is located proximate an end area of said cabinet-side slide rail and at least a second one of said plurality of elastic spring width equalization elements is disposed proximate an opposite end area of said cabinet-side slide rail.

7. Drawer slide according to claim 6 wherein said elastic spring width equalization elements are coupled to the respective end areas of the cabinet-side slide rail.

8. Drawer slide according to claim 1 wherein the drawer slide element further comprises an angle rail.

9. Drawer slide according to claim 8 wherein the elastic spring width equalization element is releasably attached on the angle rail.

10. Drawer slide according to claim 8 wherein the cabinet-side slide rail is releasably attached on the angle rail and is axially lockable to the angle rail by an axial catch that allows said movement of the cabinet-side slide rail in said direction transversely of the longitudinal axis of the angle rail and prevents movement of the cabinet-side slide rail relative to the angle rail in said direction parallel to the longitudinal axis of the angle rail.

11. Drawer slide according to claim 10 further comprising a damping braking friction surface disposed on at least one of the cabinet-side slide rail and the angle rail that resists relative movement between the cabinet-side slide rail and the angle rail in said direction transverse of the longitudinal axis of the angle rail.

12. Drawer slide according to claim 11 wherein said damping braking friction surface further comprises corrugations formed on at least one of the cabinet-side slide rail and the angle rail that extend parallel to said longitudinal axis of the angle rail.

13. Drawer slide according to claim 8 further comprising a crosswise catch locking the cabinet-side slide rail and the angle rail to one another in the fully closed position of the drawer.

14. Drawer slide according to claim 13 wherein the crosswise catch further comprises at least one clamp lever.

15. Drawer slide according to claim 14 wherein the clamp lever is actuateable to urge the damping braking friction surface disposed on said at least one of the cabinet-side slide rail and the angle rail into contact with a corresponding damping braking friction surface disposed on the respective other of the cabinet-side slide rail and angle rail.

* * * * *

UNITED STATES PATENT AND TRADEMARK OFFICE

CERTIFICATE OF CORRECTION

PATENT NO. : 6,986,558 B2
DATED : January 17, 2006
INVENTOR(S) : Remo Egger

It is certified that error appears in the above-identified patent and that said Letters Patent is hereby corrected as shown below:

Column 8,
Line 8, "prises at least one of a spiral spring, a leaf spring, a plate" should read -- prises at least one of a spiral spring, a left spring, a plate --.

Signed and Sealed this

Eleventh Day of April, 2006

JON W. DUDAS
*Director of the United States Patent and Trademark Office*